US005161792A

United States Patent [19]

Wood

[11] Patent Number: 5,161,792

[45] Date of Patent: Nov. 10, 1992

[54] MACHINE FOR TRANSFORMING A STACK OF SIGNATURES INTO A SHINGLED STREAM

[75] Inventor: James R. Wood, Marion County, Ill.

[73] Assignee: St. Denis Manufacturing Co., Effingham, Ill.

[21] Appl. No.: 697,189

[22] Filed: May 8, 1991

[51] Int. Cl.[5] ..... B65H 1/22

[52] U.S. Cl. ..... 271/151; 271/31.1; 198/462

[58] Field of Search ..... 271/149, 150, 151, 147, 271/31.1, 216, 188; 198/627, 423, 462; 53/399, 443, 542, 529

[56] References Cited

U.S. PATENT DOCUMENTS

| | | | |
|---|---|---|---|
| 4,531,343 | 7/1985 | Wood | 271/151 |
| 4,641,489 | 2/1987 | Wood | 271/150 |
| 4,771,896 | 9/1988 | Newsome | 271/35 |
| 4,809,964 | 3/1989 | Wood | 271/151 |

*Primary Examiner*—Robert P. Olszewski
*Assistant Examiner*—Kenneth Noland
*Attorney, Agent, or Firm*—Gravely, Lieder & Woodruff

[57] ABSTRACT

A machine for converting a group of marginally registered signatures into a shingled stream which is fed to the hopper of a binding machine includes a main frame and several conveyors located in succession along the frame. The first is a feed conveyor having driven side belts which are arranged to allow one's hand to move along the conveyor and install stacks of signatures with the signatures being in an edge standing condition on the feed conveyor. Next comes a spreading conveyor which separates the signatures as they move in the edge standing condition between side belts which impart a slight bow to the signatures. Constricting gates exist between the feed and spreading conveyors and they sense the force with which the signatures are introduced into the feed conveyor. Then comes a lifting conveyor which lifts the signatures from the spreading conveyor in a shingled condition. Sensors exist at the end of the spreading conveyor to control the relative speeds of the side belts for the spreading conveyor so that the signatures approach the lifting conveyor evenly and will not skew on the lifting conveyor. Backing belts hold the shingled signatures against the belts of the lifting conveyor as the signatures rise, and the belts are maintained taut and against the signatures by the weight of an articulated frame over which they pass. The lifting conveyor directs the shingled signatures onto a delivery conveyor, which at its very end imparts a curvature to the signatures so that they do not fold under as they are projected beyond the end of the delivery conveyor.

31 Claims, 4 Drawing Sheets

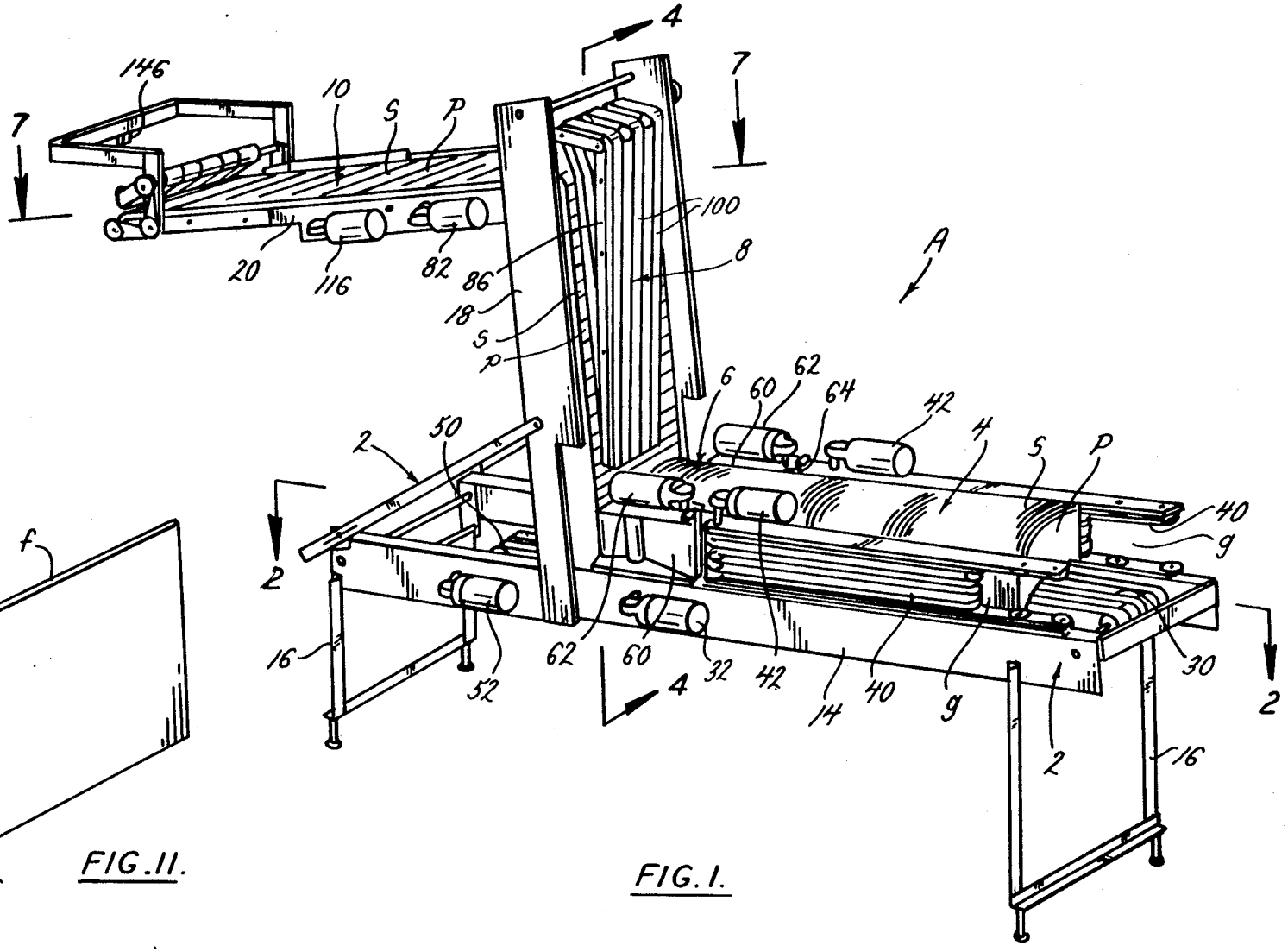
FIG. I.
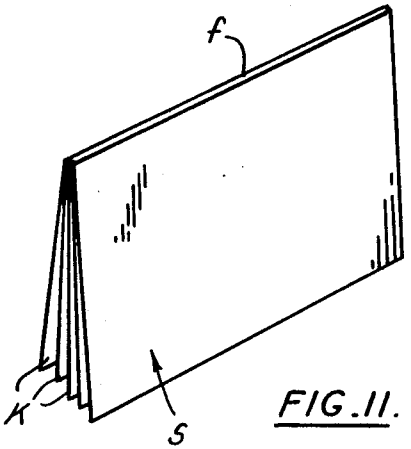
FIG. II.

FIG. 8.
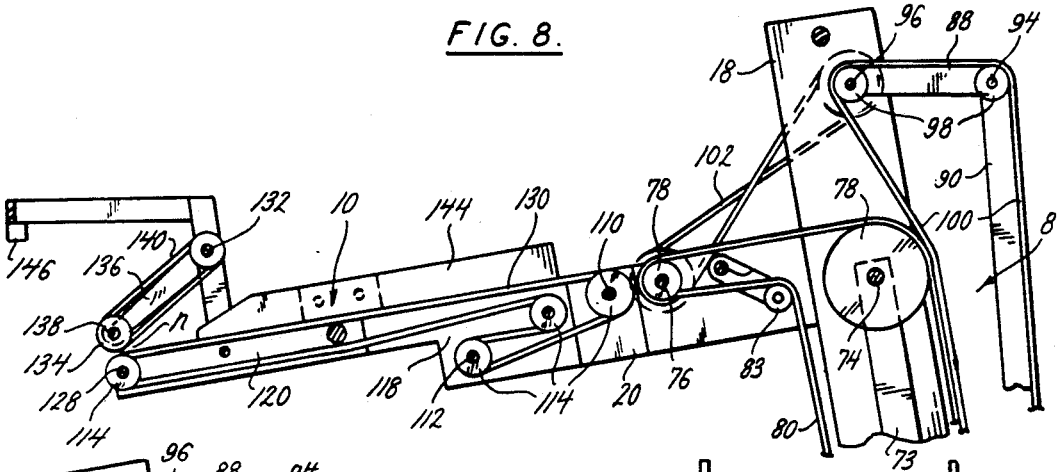
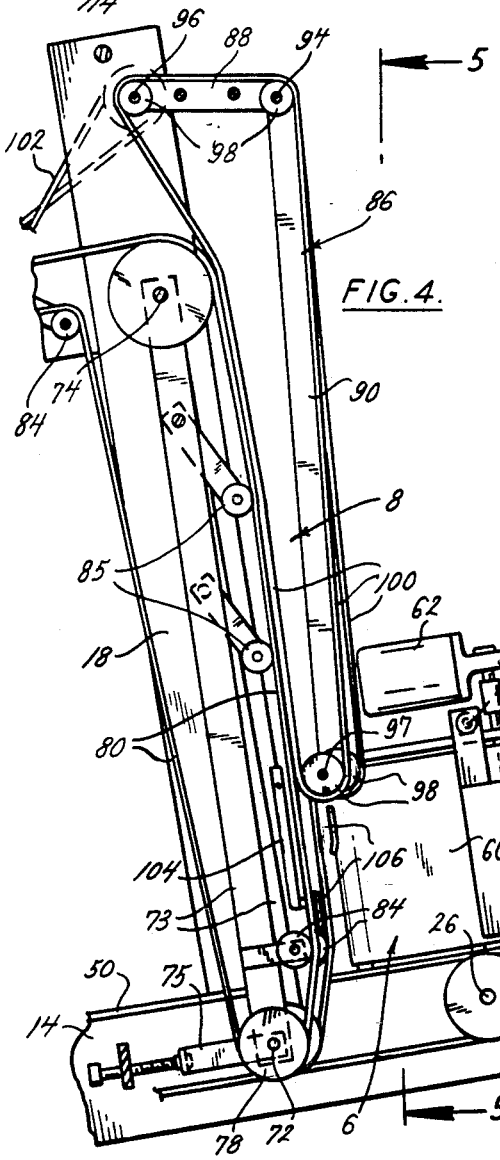
FIG. 4.
FIG. 5.
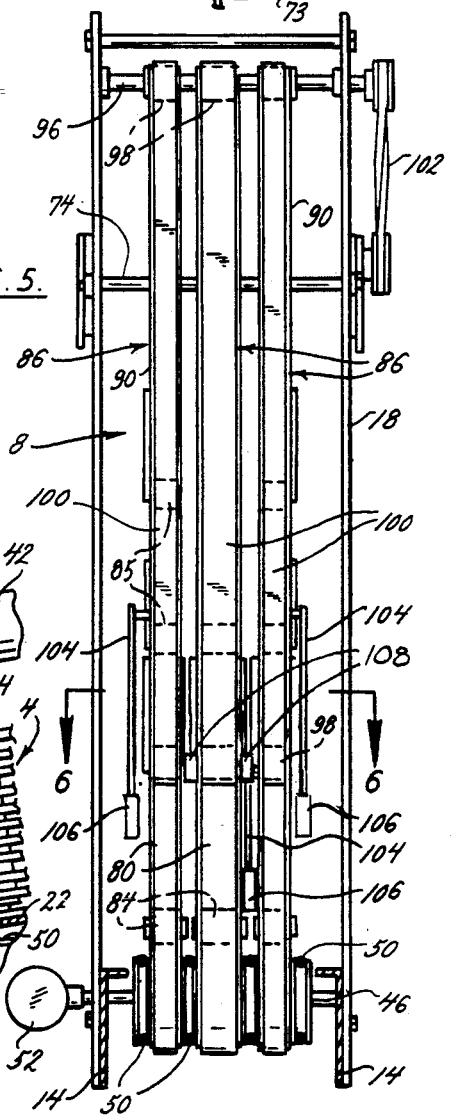

MACHINE FOR TRANSFORMING A STACK OF SIGNATURES INTO A SHINGLED STREAM

BACKGROUND OF THE INVENTION

This invention relates in general to the handling of discrete pieces of flexible sheet material and more particularly to a machine for separating such pieces of sheet material when they are face to face in marginal registration and directing them to a desired location.

Printing magazines and similar publications involves a considerable amount of material handling. Large offset presses deliver the printed material as folded signatures which are arranged in stacks by the machine. Workmen remove the stacks from the presses and deposit them on pallets on which they are stored or the workmen may bind short stacks of the signatures together with bands to form longer bundles or logs. Since the bands maintain the signature under compression, the bundles or logs conserve storage space. By reason of the storage, one or two presses may produce all the signatures required for a magazine.

Once all of the signatures for the magazine are available, workmen break the stacks or bundles into smaller stacks called hand lifts and introduce the hand lifts into a binding machine which assembles their signatures in the proper order into a magazine. The typical binding machine has a succession of pockets, one for each signature required by the publication. Each pocket holds a stack of like signatures no more than about 14 inches tall. Binding machines as a whole are quite temperamental, and underfeeding or overfeeding the pockets on such machines can cause misfeeds. For example, if a pocket has too many signatures, the weight of those signatures inhibits the extracting mechanism from removing signatures, whereas too few signatures increases the chances of a double extraction. As a result, a binding machine requires several workmen to monitor its pockets, and to supply each of those pockets with a limited amount of signatures when it becomes low. This is manual labor, and while not overly difficult, it may lead to a physical ailment known as carpal tunnel syndrome, which is very painful. It requires expensive surgery for correction and even then the condition may reoccur.

Stream feeders exist for feeding the pockets of binding machines, but the machines of current manufacture operate on an incremental basis, so rarely do the pockets they feed contain the optimum number of signatures. Moreover, they are in themselves difficult to feed, and require excessive amounts of compressed air, which makes them expensive to operate.

The present invention resides in a stream feeder for removing signatures from a bundle or stack that exists in the form of an edge-standing array and delivering those signatures to another location, such as a pocket of a binding machine, in a continuous stream, indeed a stream which may be adjusted to match the demand at the location at which the signatures are required. It will thus maintain the pocket of a binding machine at an optimum level and thereby reduce the incidence of misfeeds from that pocket. Multiple stream feeders enable a single workman to service more pockets with less effort, and to avoid the motions which contribute to carpal tunnel syndrome. The stream feeder is quite compact, and therefore occupies little floor space.

Moreover, it requires relatively little compressed air and is otherwise inexpensive to operate.

DESCRIPTION OF THE DRAWINGS

In the accompanying drawings which form part of the specification and wherein like numerals and letters refer to like parts wherever they occur.

FIG. 1 is a perspective view of a machine constructed in accordance with and embodying the present invention, the machine being illustrated with signatures along its several conveyors to show the conversion of the signatures from an edge-standing array to a shingled condition;

FIG. 4 is a sectional view taken along line 4—4 of FIG. 1 and showing the spreading and shingling conveyors;

FIG. 5 is an elevational and sectional view taken along line 5—5 of FIG. 4 and likewise showing the shingling conveyor;

FIG. 8 is a sectional view taken along line 8—8 of FIG. 7;

FIG. 11 is a perspective view showing a typical signature.

DETAILED DESCRIPTION

Figure 2:
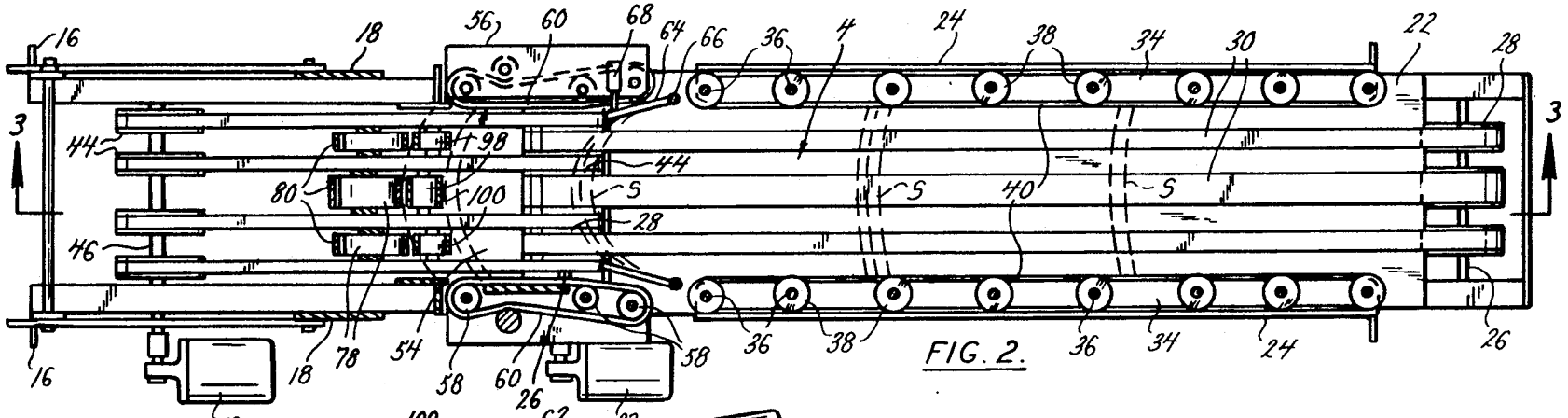
FIG. 2 is a sectional view of the machine taken along line 2—2 of FIG. 1 and showing primarily the feed and spreading conveyors.

Referring now to the drawings, a machine A (FIG. 1) known as a stream feeder, converts logs or bundles of stacked signatures S or other flexible sheets which stand on edge in marginal registration, into a shingled stream which is delivered to a desired location where the signatures S or sheets are deposited one after the other. The machine is particularly useful in breaking logs or bundles of signatures S, elevating the signatures S in a shingled condition, and conveying the signatures S horizontally again in a shingled condition to the pocket of a binding machine, where they are placed one after another, to accumulate in a loose vertical stack in the pocket. The signatures S are typical, each one consisting of several sheets of paper folded over along a fold line f to create pages k (FIG. 11).

The machine A includes (FIG. 1) a main frame 2 over and along which a conveying path P extends, and it is along the path P that the signatures S are taken from a tight bundle, placed in a shingled condition, elevated, and ultimately delivered to a desired location one after the other. The frame 2 supports several conveyors which actually form the path P, namely a feed conveyor 4, a spreading conveyor 6, a shingling conveyor 8 and a delivery conveyor 10. The frame 2 has a horizontal section 14 and legs 16 for supporting the horizontal section 14 at a convenient elevation above the ground. The feed conveyor 4 and spreading conveyor 6 lie along the horizontal section 14. In addition, the frame 2 has an upright section 18 that extends upwardly from the horizontal section 14, and an elevated section 20 that projects generally horizontally from the upright section 18. The shingling conveyor 8 extends primarily along the upright section 18 and partially along the elevated section 20, whereas the delivery conveyor 10 lies along the elevated section 20.

Figure 3:
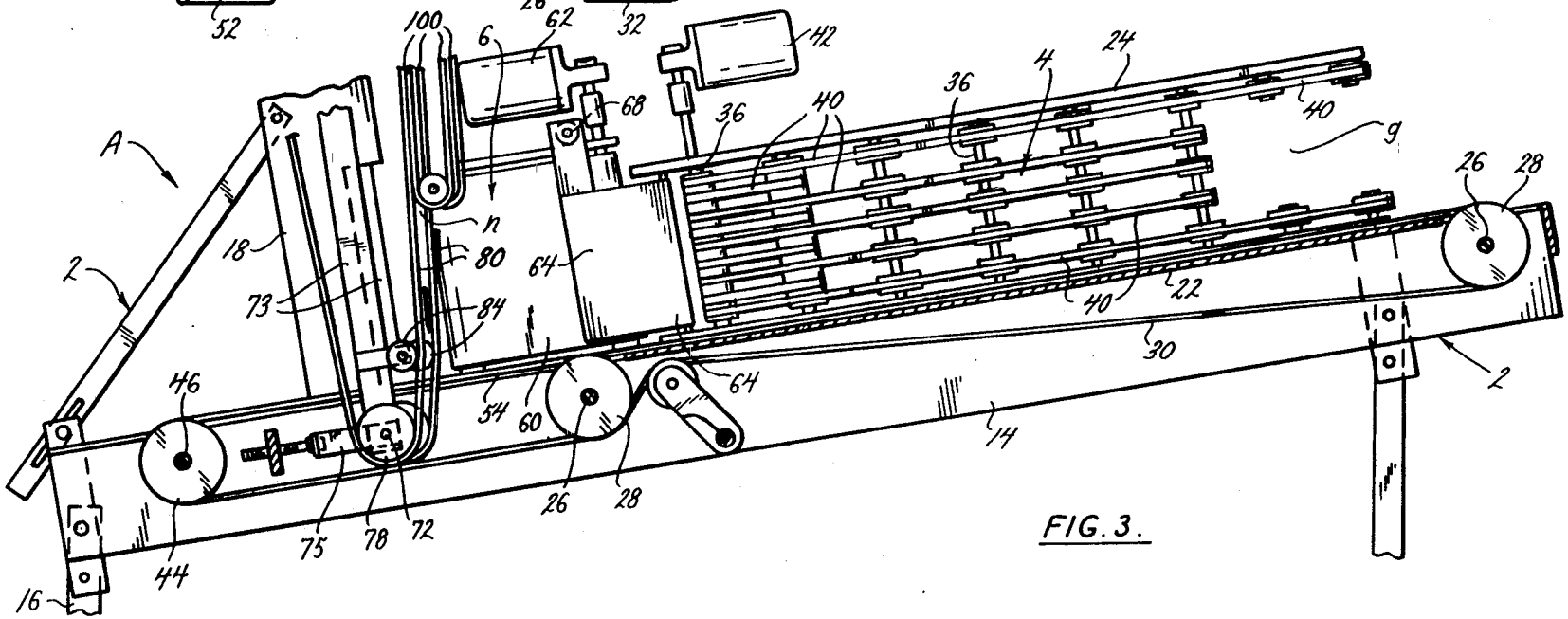
FIG. 3 is a sectional view taken along line 3—3 of FIG. 2 and likewise showing the feed and spreading conveyors as well as the lower portion of the shingling conveyor.

The feed conveyor 4 includes (FIGS. 2 & 3) a base plate 22 that is attached to the horizontal section 14 of the frame 2 and two side frames 24 which lie along the sides of the horizontal section 14 where they project upwardly from the plate 22, thus imparting a channel shaped configuration to the conveyor 4. The horizontal section 14 of the main frame 2 carries two horizontal shafts 26 having pulleys 28 mounted on them, and the pulleys 28 carry three flat table belts 30, the upper passes of which extend over the base plate 22. The downstream shaft 26 is connected to a variable speed gear motor 32 which drives its pulleys 28 and the belts 30, causing the upper passes of the belts 30 to move over the base plate 22 toward the spreading conveyor 6.

Each of the side frames 24 includes upper and lower bars 34 as well as shafts 36 which extend between the bars 34, and while one of the shafts 36 lies at the downstream ends of the side frame 24, no full shaft 36 exists at the upstream end. The shafts 36 carry pulleys 38 over which side belts 40 pass. At the upstream end of the side frame 24, more pulleys 38 are mounted on stub axles that extend from the bars 34, and while the pulleys 38 on the upper and lower bars 34 are axially aligned, they are not connected. Indeed, a gap g large enough to accommodate one's hand exists between them. The uppermost and the lowermost of the side belts 40 are longer than the intervening side belts 40 and at the upstream end of the conveyor 4 they pass over the pulleys 38 that are on the stub axles. At the downstream end of the feed conveyor 4 a variable speed gear motor 42 is mounted on each side frame 24, and that motor is coupled to the endmost shaft 36 to drive the shaft 36 and the side belts 40 such that the inner passes of the side felts 40 move toward the spreading conveyor 6. The vertical drive shaft 36 for each set of side belts 40, is set slightly rearwardly or upstream from the horizontal drive shaft 26 to which the motor 32 is coupled.

The two side frames 24 are adjustable inwardly and outwardly, and they are set such that the spacing between the inner passes of the two sets of side belts 40 is slightly less than the width of the signatures S. They may also be adjusted with a slight convergence or divergence. A workman simply takes a short stack or hand lift of signatures S, turns it on edge with the folds f of the signatures S preferably presented upwardly, and places the stack on the table belts 30 of the feed conveyor 4. He thereupon forces the short stack forwardly between the side belts 40. The lower edges, of course, rest on the upper passes of the table belts 30, while the side edges bear against the inner passes of the side belts 40. The three gear motors 32 and 42 move their respective belts 30 and 40 at essentially the same velocity, so a group of signatures S placed on the table belts 30 and between the side belts 40 will advance along the feed conveyor 4 in an upright orientation, that is standing on edge (FIG. 1).

The spreading conveyor 6 (FIGS. 2–4), which is the shortest of the four conveyors, lies between the downstream end of the feed conveyor 4 and the beginning of the shingling conveyor 8. It includes four pulleys 44 which are mounted on the drive shaft 26 between the pulleys 28 of the feed conveyor 4, but in contrast to the pulleys 28, which are fixed to the drive shaft 26 to drive the table belts 30, the pulleys 44 are free wheeling. In addition, the spreading conveyor 6 has a drive shaft 46 which extends across the horizontal section 14 of the frame 2 beyond the upright section 18, and the shaft 46 has four more pulleys 44 on it, but these pulleys are attached to rotate with the shaft 46. Extended over the pulleys 44 are four endless table belts 50 which form extensions of the table belts 30 of the feed conveyor 4. The shaft 46 is coupled to a variable speed gear motor 52 which is mounted on the horizontal section 14 of the frame 2 and drives the belts 50 such that their upper passes move away from the feed conveyor 4. The upper passes move over a short support plate 54.

In addition, the spreading conveyor 6 includes two side frames 56 (FIG. 2) which are attached to the horizontal section 14 of the main frame 2 where they lie between the side frames 24 of the feed conveyor 4 and the upright section 18 of the main frame 2. Each side frame 56 carries several rollers 58 around which a single side belt 60 passes, the height of which exceeds the height of the signatures S. The inside passes of the two side belts 60 for the conveyor 6 form continuations of the inside passes for the side belts 40 on the feed conveyor 4, so the spreading conveyor 6 likewise possesses a channel shaped configuration, but the rollers 58 are arranged such that the upstream ends of the inner passes for the two belts 60 are slightly oblique, so that the two belts 60 initially converge and then run generally parallel or perhaps with a slight convergence or divergence. Each side frame 56 carries a gear motor 62 which rotates the rearmost rollers 58 on that side frame 56 such that the inside pass of the belt 60 moves in the same direction as the upper passes for the belts 50, that is away from the feed conveyor 4 and toward the shingling conveyor 8.

Like the side frame 24, the side frames 56 are adjustable inwardly and outwardly on the main frame 2 to alter the spacing between the inner passes of the two side belts 60. That spacing should be slightly less than the width of the signatures S, so that the signatures S will remain bowed forwardly as they pass between the two belts 58, that is through the spreading conveyor 6. They may also be set with a slight convergence or divergence. Moreover, the gear motors 52 and 62 drive their respective belts 50 and 60 at essentially the same velocity, and that velocity is slightly greater than the velocity of the belts 30 and 40 on the feed conveyor 4. As a consequence, the signatures S tend to spread apart as they move into the spreading conveyor 6, this transition occurring generally at the horizontal drive shaft 26 which carries both the downstream pulleys 28 for the table belts 30 of the feed conveyor 4 and the upstream pulleys 44 for the table belts 50 of the spreading conveyor 6.

Actually, each of the three motors 52 and 62 for the spreading conveyor 6 operates independently, and its speed is precisely controlled to control the orientation of the signatures S on the spreading conveyor 6. This is important, because the signatures S must approach the shingling conveyor 8 in the proper orientation. For example, if the signatures S become cocked on the spreading conveyor 6 so that one side lags, the speed of the side belt 60 along the lagging side is increased. By the same token, if the bottom edge tends to lag, the speed of the table belts 50 is increased.

The rollers 58 which drive the two side belts 60 for the spreading conveyor 6 lie generally at the horizontal drive shaft 26 which forms the transition between the feed conveyor 4 and the spreading conveyor 6, so the inner passes of the side belts 60 for the spreading conveyor 6 begin at that region. The drive shafts 36 for the side belts 40 of the feed conveyor 4 are offset slightly to the rear or downstream, so that spaces exist between the side belts 40 of the feed conveyor 4 and the side belts 60 of the spreading conveyor 6. Those spaces are occupied by gates 64 (FIGS. 2–4) which project into the channel formed by the two conveyors 4 and 6 generally at the transition between the two. The gates 64 are in effect plates which pivot on rods 66 carried by the side frames 24 of the feed conveyor 4, but are urged inwardly by springs. Each rod 66 is monitored by a sensor 68 which produces a signal reflecting the angular position of the gate 64 on that rod 66. Normally, the gates 64 lie along the oblique portions of the inner passes for the side belts 60.

As the signatures S pass from the feed conveyor 4 to the spreading conveyor 6, their bottom edges move directly from the table belts 30 of the feed conveyor 4 to the table belts 50 of the spreading conveyor 6. However, this type of transition does not occur at the vertical edges of the signatures S. Those edges, instead of passing directly from the side belts 40 of the feed conveyor 4 to the side belts 60 of the spreading conveyor 6, pass over the pivoted gates 64 between the side belts 40 and 60. The gates 64, being urged inwardly by their respective springs, cause the signatures S to mass somewhat at the entrance to the spreading conveyor 6, and the angles that the gates 64 assume reflect the force with which the feed conveyor 4 drives the signatures S into the spreading conveyor 6. The electrical circuitry to which the sensors 68 are attached controls the gear motor 32 for the table belts 30 and the gear motors 42 for the side belts 40 of the feed conveyor 4, with the speed at which those motors operate being such that the belts 30 and 40 seek to maintain the gates 64 at a desired angle, which of course represents a desired force on the signatures S at the entrance to the spreading conveyor 6. Actually, the two gates 64 may assume slightly different angles, but the circuitry, in effect, computes an average of the two angles. Even so, the circuity is such that the motors 32 and 42 never stop altogether as long as the motors 52 and 62 of the conveyor 6 downstream from the gates 64 continue to operate, and this insures the presence of signatures S at the upstream end of the conveyor 6.

In order for the shingling conveyor 8 to operate properly, some separation must exist between the edge-standing signatures S on the spreading conveyor 6. If those signatures S are packed tightly together under back pressure from trailing signatures in the feed conveyor 4, the shingling conveyor 8 may tear the signatures S and certainly will not be able to extract the signatures S from the end of the spreading conveyor 6 with the ease required to establish a uniform shingle. Only the side edges of the signatures S contact the gates 64 and the angular position of the gates 64 along a group of signatures S at the gates 64 depends on the amount of bow within those signatures S. After all, a signature S possessing considerable bow will have its side edges located closer together than one having less bow. The gates 64 will, of course, pivot inwardly in the presence of the former and outwardly in the presence of the latter. The machine A utilizes this phenomenon to produce a very stable electrical control loop.

More specifically, the sensors 68 which monitor the gates 64 produce signals which reflect the angular deflection of the gates 64. The signals from the two gates 64 are processed to produce an arithmetic average. The resulting or new signal has been found to be predominantly related to the back pressure experienced by the signatures S passing from the feed conveyor 4 to the spreading conveyor 6 at the gates 64, and this new signal is used to control the speed of the motors 32 and 42 and of course the belts 30 and 40 of the feed conveyor 4. The new signal is extremely reliable.

Even so, the new signal is further processed to prevent complete stoppage of the feed conveyor motors 32 and 42 as long as the spreading conveyor 6 and shingling conveyor 8 continue to operate, so the feed conveyor 4 never totally stops delivering signatures S to the spreading conveyor 6, even though the gates 64 suggest a condition of over pressure. These indications of over pressure are usually transient, so the continued operation of the feed conveyor 4, albeit at reduced output, insures continuity in the delivery of signatures S to the spreading conveyor 6. The reduced speed is proportional to the speed at which the shingling conveyor 8 operates.

The shingling conveyor 8 for the most part lies along the upright section 18 of the main frame 2, although the downstream end of it extends into the nearby portion of the elevated section 20. The shingling conveyor 8 includes (FIGS. 4–6 & 8) three cross shafts 72 which lie at the lower end of the upright frame section 18 where each extends between the lower ends of two slightly spaced hanger arms 73. Thus, three pairs of hanger arms 73 exist, and while they lie generally within the upright frame section 18, they extend into the spaces between the upper passes of the four table belts 50 of the spreading conveyor 6. The hanger arms 73 are supported at their upper ends by an upper shaft 74 which extends across the upright frame section 18, and while the hanger arms 73 can pivot on the shaft 74 at their upper ends, the arms 73 are stabilized with adjusting linkages 75 (FIG. 4) which are anchored on the horizontal frame section 14. Each pair of hanger arms 73 has its own adjusting linkage 75, and that linkage 75 enables the shaft 72 at the lower ends of the arms 73 for the pair to be moved forwardly and rearwardly. The three pairs of arms 73 are set such that the two outside shafts 72 are slightly offset from the center shaft 72. The shingling conveyor 8 also has a drive shaft 76 which extends across the elevated frame section 20 near the upright section 18. Each of the lower shafts 72 is fitted with a pulley 78 and those pulleys 78 lie between the pairs of hanger arms 73 to which the shafts 72 are fitted. The upper shaft 74 carries three more pulleys 78 and they likewise lie between the pairs of hanger arms 73, so that they align with the pulleys 78 on the three lower shafts 72. The drive shaft 76 has three additional pulleys 78 which are fitted securely to it, and they align with the pulleys 78 on the upper shaft 74 and the lower shafts 72. Thus, the pulleys 78 are arranged in three sets—and each set carries a separate lift belt 80.

The lift belts 80 have lifting passes which begin slightly above the pulleys 78 of the lower shafts 72 and end at the pulleys 78 of the upper shaft 74. As such their lower ends lie at the end of the channel formed by the spreading conveyor 6. Indeed, the belts 80 rise between the table belts 50 of the spreading conveyor 6 and form the downstream end of the spreading conveyor 6. At the pulleys 78 of the upper shaft 74 the lifting passes of the lift belts 80 turn generally horizontally and merge into adjacent passes which extend forwardly to the pulleys 78 of the drive shaft 76. Both the lifting passes and the adjacent horizontal passes of the lift belts 80 convey the signatures S. At the pulleys 78 of the drive shaft 76 the adjacent horizontal passes become the return passes which extend over diverting pulleys 83 located where the elevated section 20 of the frame 2 projects from the upright section 18. The diverting pulleys 83 are adjustable to eliminate slack from the belts 80. The gear motor 82 drives the shaft 76 and the pulleys 78 that are on it to move the lift belts 80 such that the lifting passes move upwardly from the downstream end of the spreading conveyor 6 to the pulleys 78 on the upper shaft 74, and they thereby lift the signatures S out of the channel formed by spreading conveyor 6.

Actually, the three lift belts 80 elevate the signatures S in succession from the end of the spreading conveyor 6, but before any signature S clears the end of the spreading conveyor 6, the belts 80 lift the next one, so that the elevated signatures S overlap on the conveyor 8. In other words, the lift belts 80 move the signatures S in a shingled condition, that is as a shingled stream. In order to prevent skewing on the shingling conveyor 8 and to obtain uniform pitch within the shingle, the lifting passes of the belts 80 must be positioned properly with respect to the signatures S at the downstream end of the spreading conveyor 6. To this end, each pair of hanger arms 73 carries a lower positioning pulley 84 (FIG. 4) which is located slightly above the upper passes of the table belts 50 for the spreading conveyor 6, so that the belts 80 upon leaving the pulleys 78 at the lower ends of the arms 73 approach the end of the spreading conveyor 6 somewhat obliquely. This insures that the lift belts 80 contact the endmost signature S in the spreading conveyor 6 slightly above the table belts 50 of the spreading conveyor 6. The lower positioning pulleys 84 mark the beginnings of the lifting passes for the three lift belts 80. The adjusting linkages 75 offset the outside pairs of hanger arms 73 from the center pair such that the two outside belts 80 are projected farther toward the gates 64, and indeed the offset is such that the three belts 80 at their lower positioning pulleys 84 are arranged to conform to the bow in the signatures S that approach them on the spreading conveyor 6.

Each pair of hanger arms 73 for the two outside belts 80 also carries an upper positioning pulley 85 which is attached to its hanger arms 73 above the spreading conveyor 6 with a bracket that enables the pulley 85 to be moved toward and away from the pair of hanger arms 73 to position the belt 80 at an appropriate angle in the end of the spreading conveyor 6. The upper positioning pulleys 85 on the outside hanger arms 73 should be located above the array of bowed signatures S in the spreading conveyor 6 a distance that is about the height of a signature S. The pair of hanger arms 73 for the center belt 80 likewise carries an upper positioning pulley 85 on an adjustable bracket, but that pulley 85 contacts the center belt 80 somewhat higher than where the other upper pulleys 85 contact the outside belts 80. The vertical distance between the upper pulleys 85 for the outside belts 80 and the upper pulley 85 for the center belt 80 should be about the height of a signature S, whereas, the upper pulley 85 for the center belt 80 lies beneath the pulleys 78 of the upper shaft 74 a distance that should equal or exceed the height of a signature S.

The upper positioning pulleys 85 on the three pairs of hanger arms 73 hold the lifting passes of the three lift belts 80 parallel after they come off of the lower positioning pulleys 84 (FIG. 4). In this regard, were it not for the upper positioning pulleys 85 the outside lift belts 80 would lie slightly skewed with respect to the center lift belt 80 immediately above the lower positioning pulleys 84, because the lifting passes at all three belts 80 end at the pulleys 78 of equal diameter which rotate on the common shaft 74. To conform to the curvature of the signatures S in the spreading conveyor 6, the lifting passes of the three lift belts 80 must remain parallel at the end of the spreading conveyor 6, and the upper positioning pulleys 85 establish this parallelism. Beyond their upper positioning pulleys 85 the lifting passes of the three lift belts 80 extend directly to the pulleys 78 of the upper shaft 74 and in the region beyond the upper positioning pulley 85 for the center belt 80, that is between the upper pulley 85 for the center belt 80 and the corresponding pulley 78 of the upper shaft 74, all three belts 80 lie in the same plane. In short, they are coplanar in this region. This ensures that signatures S approach the curved transition between the lifting passes and the adjacent horizontal passes of the three belts 80 in a flat condition.

In addition, the shingling conveyor 8 includes articulated frames 86 (FIG. 4) formed from pairs of short arms 88 and pairs of long arms 90, with the short arm 88 for each frame 86 forming a generally horizontally directed section and the long arms 90 forming a generally vertical section. The arms 88 and 90 for each frame 86 are joined together by short cross shafts 94 which pass through the rear ends of the short arms 88 and the upper ends of the long arms 90. The articulated frames 86 are connected to the upright section 18 of the main frame 2 by another shaft 96 which is common to all the frames 86 and extends across the upright section 18 of the main frame 2 generally above the upper shaft 74 where the lift belts 80 turn forwardly, and indeed the shaft 96 passes through the opposite or forward ends of the short arms 88. The frames 86 are truly articulated with respect to both the main frame 2 and themselves in that the short arms 88 pivot on the shaft 96 relative to the upright section 18 of the main frame 2 and the long arms 90 pivot relative to the short arms 88 on the shafts 94.

The long arms 90 depend downwardly along the upright section 18 of the main frame 2 and terminate slightly above the spreading conveyor 6 (FIG. 4), or at least high enough above the table belts 50 of that conveyor to enable the upright signatures S to pass beneath them and against the lifting passes of the lift belts 80. Actually, each pair of long arms 90 is presented opposite the lifting pass of a different lift belt 80, and between the lower ends of the long arms 90 for each pair is a short shaft or axle 97 and a pulley 98 which rotates on it and of course is likewise located opposite to one of the lift belts 80. More pulleys 98 are fitted to the shafts 94 and 96 between the arms 88 and 90 of each pair, and they are likewise located opposite the lift belts 80.

Finally, the articulated frames 86 carry backing belts 100 (FIGS. 4–6) which extend around their pulleys 98. The backing belts 100 follow the pairs of short and long arms 88 and 90 of the frames 86, forming inner and outer runs along them. The inner runs lie opposite and generally conform to the lifting passes of the lift belts 80 in the sense that they are deflected by the upper positioning pulleys 85. They are also deflected at the pulleys 78 on the upper shaft 74. At the lower transition between the inner and outer runs of the backing belts 100, the backing belts 100 establish nips n with the lift belts 80. The backing belts 100 serve to hold signatures S against the lifting passes of the lift belts 80 as the lift belts 80 elevate those signatures S in a shingled condition away from spreading conveyor 6 (FIG. 1). No springs act on the frames 86 to urge the backing belts 100 toward the lift belts 80. Instead, the weight of the short and long arms 88 and 90, and particularly the latter, urges the lower regions of the backing belts 100 downwardly, thus making them taut over the pulleys 98 and in the deflected regions at the upper positioning pulleys 85 and the pulleys 78 for the upper shaft 74. Since the frames 86 pivot at both of the shafts 94 and 96, they will accommodate displacements in the deflected inner runs of the backing belts 100 simply by rising or dropping, and this of course enables the backing belts 100 to exert a uniform backing force on the signatures S irrespective of the thickness of the signatures S captured between the lifting belts 80 and backing belts 100. That thickness will vary, it being largely dependent on the number of pages in the signatures S. Like the lift belts 80, the backing belts 100 are also driven—indeed, at generally the same velocity and in the same direction—so that the inner runs of the backing belts 100 move with the lifting passes of the lift belts 80. To this end, the shaft 96, which rotates at the upper end of the upright frame section 20, is coupled to the drive shaft 76 by a belt drive 102, so that both shafts 76 and 96 are powered by the gear motor 82.

Figure 6:
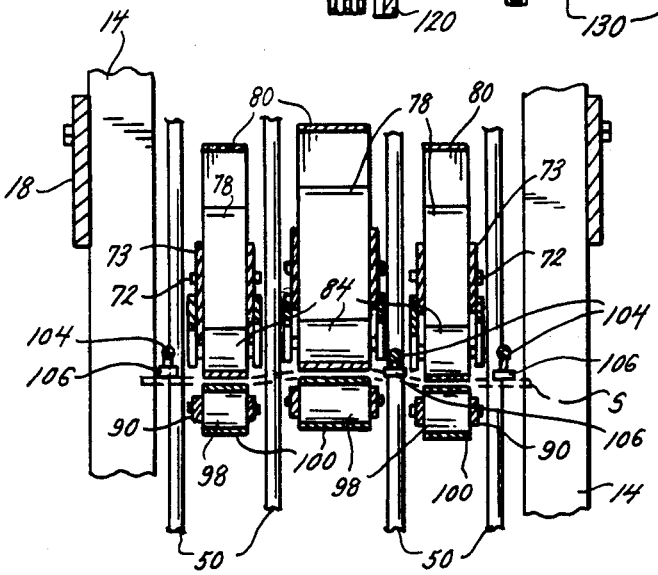
FIG. 6 is a sectional view taken along line 6—6 of FIG. 5 and showing a signature captured between the lift and backing belts of the shingling conveyor in a bowed condition.

The spreading conveyor 6 moves the loosely arranged and forwardly bowed signatures S on edge beneath the lower regions of the backing belts 100 for the shingling conveyor 8 and against the lifting passes of the lift belts 80. The lift belts 80 as they pass over and beyond the lower positioning pulleys 84 frictionally grip the bowed signatures S at the forwardly presented pages of those signatures and lift them upwardly, in succession, off the table belts 50 of the spreading conveyor 6 (FIG. 6). After a short rise the upper end of each signature S moves into the nips n between the lift belts 80 and backing belts 100, and thereafter the backing belts 100 hold the signature S against the rising lifting passes of the lift belts 80. After the signature S undergoes a short rise, considerably less than its height and generally equally the spacing between the lower positioning pulleys 84 and the table belts 50, the next signature S on the spreading conveyor 6 will come against the lifting passes of the lift belts 80, and the belts 80 likewise elevate that signature S, so that the trailing signature S overlaps the leading signature S while the lift belts 80 elevate them. As a consequence, the signatures S assume a shingled condition on the shingling conveyor 8. The forward bow in the signature S at the end of the spreading conveyor 6 prevents the signatures S from experiencing roll-up as they are gripped along the forwardly presented pages and urged upwardly. Roll up is the tendency of one page of a signature to slide along the passage behind it and thereby displace or roll the fold f in the sheet of which it is a part. The bow however diminishes due to the arrangement of the lift belts 80 along their lifting passes, and disappears by the time the signatures S pass over the upper positioning pulley 85 for the center belt 80, so the signatures S approach the pulleys 78 of the upper shaft 74 in a flat condition. Being flat along the upper regions of the lifting passes, the signatures S easily bend with the belts 80 as they pass over the pulleys 78 on the upper shaft 74, and indeed they are directed forwardly by the upper deflected portions of the backing belts 100 as those deflected portions move on to the pulleys 98 of the forward shaft 96.

The orientation of the edge-standing signatures S on the spreading conveyor 6 is important, particularly at the point of lift, because it affects the orientation of the signatures S in the shingling conveyor 8 and to a measure the pitch of the shingle that is established. For example, if one side of a signature S gets ahead of the other side on the spreading conveyor 6, the signature S will become skewed on the shingling conveyor 8, because the leading side will contact the one outside lift belt 80 before the trailing side contacts the other outside lift belt 80. On the other hand, if the signature S tilts too far forwardly at its fold f, the signature S will not present enough surface area toward the lift belts 80 to be gripped by them, and the pitch of the shingle will not be uniform. If the signatures S tilt too far backwardly they tend to clump on the shingling conveyor 8 and again the pitch is not uniform. In other words, the vertical orientation of the signatures S on the spreading conveyor 6 affects the shingle which develops on the shingling conveyor 8, and that orientation should be such that the signatures S develop a uniform pitch. The machine A overcomes these problems by monitoring the orientation of the signatures S at the very end of the spreading conveyor 6 and by controlling the speed of the gear motors 52 and 62—and hence the speed of the table belts 50 and side belts 60—to ensure that the signatures S approach the shingling conveyor 8 in the proper orientation.

To this end, the upright section 18 of the main frame 2 carries three swing arms 104 (FIGS. 4–6)—one adjacent the center lift belt 80 and the other two located outside or slightly laterally beyond the outside belts 80—and these arms 104 depend from their pivot points into the pick up region for the shingling conveyor 8. Each arm 104 at its lower end is fitted with a sensing element 106, in the shape of a ski, which protrudes beyond the belt 80 along which it lies and contacts the signatures S as the signatures S come against the lift belts 80 and are elevated. Of course, as a signature S moves upwardly, it simply slides over the sensing elements 106 and gives position to the sensing elements 106 and their arms 104. The element 106 on the center arm 104 is located somewhat below the elements 106 on the two side arms 104 (FIGS. 4 & 5). It contacts the leading signatures S on the spreading conveyor 6 near the table belts 50 of the spreading conveyor 6. The elements 106 of the side arms 104, on the other hand, contact the signatures S near their folds f, which are preferably presented upwardly. Each arm 104 is connected to a potentiometer which sends a signal reflecting the position of the arm 104 and the sensing element 106 at the lower end of the arm 104. When the signals for the two side arms 104 balance, the elements 106 on those arms 104 are in the same position relative to the belts 80 along which they lie, and since the leading signatures S determine the position of the elements 106, this indicates that the signatures S have approached the lift belts 80 with their sides even. Should one side lag, the element 106 at that side will project farther beyond its adjacent lift belt 80 and the potentiometers will register an imbalance. The imbalance in turn produces an increase in the speed of the motor 62 that drives the side belt 60 which the lagging side contacts. The sides of the signatures S are thus maintained even so that they approach the outside lift belts 80 of the shingling conveyor 8 uniformly.

The potentiometer for the center arm 104 senses any deviation from an initial setting and increases or decreases the speed of the motor 52 for the center belts 50 so as to maintain that initial setting, which of course represents a desired position for the lower edge of the signatures S as they approach the center lift belt 80. That initial setting is derived by overriding the potentiometer of the center element 106 and adjusting the speed of the table belts 50 for the spreading conveyor until the shingle in the signatures S on the shingling conveyor 8 is uniform. That pitch should approximate the short distance between the axes of the positioning pulleys 84, which establish the beginning of the lifting passes for the belts 80, and the upper passes of the table belts 50 for the spreading conveyor 6.

Four page signatures S (one sheet and one fold f) do not separate as easily at the end of the spreading conveyor 6 as do thicker signatures S, and to achieve better separation jets of air may be introduced between the leading signature S and the next signature S. To this end, the long arms 90 for the frames 86 may be fitted with nozzles 108 (FIGS. 4 & 5) to which hoses delivering compressed air are attached.

Figure 7:
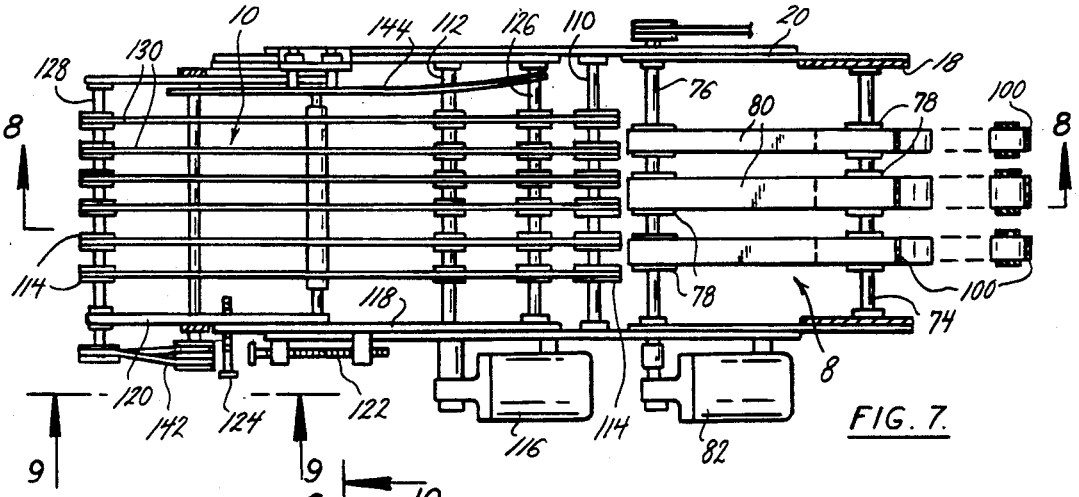
FIG. 7 is a sectional view taken along line 7—7 of FIG. 1 and showing the terminal position of the shingling conveyor and the delivery conveyor.

The delivery conveyor 10 lies along the elevated section 20 of the main frame 2 beyond the downstream end of the shingling conveyor 8. It includes (FIGS. 7 & 8) an end shaft 110 located immediately beyond the drive shaft 76 of the shingling conveyor 8 as well as a drive shaft 112 located somewhat ahead of the end shaft 110, yet set below it. Both the end shaft 110 and the drive shaft 112 are fitted with pulleys 114. The drive shaft 112 is coupled to a gear motor 116 which is attached to the elevated section 20 of the frame 2.

The elevated section 20 of the main frame 2 carries an extensible frame 118 (FIGS. 7 & 8) which projects beyond the end of the elevated section 20, and the extensible frame 118 in turn carries an end frame 120 which projects beyond the downstream end of the extensible frame 118. The extensible frame 118 moves longitudinally with respect to the elevated section 20 of the main frame 2, whereas the end frame 120 moves transversely on the extensible frame 118. Indeed, the extensible frame 118 is provided with a mechanism 122 (FIG. 7) for extending and retracting it on the elevated section 20, whereas the end frame 120 has a mechanism 124 for moving it left and right on the extensible frame 118. At its downstream end, which is within the confines of the elevated section 20, the extensible frame 118 is fitted with a cross shaft 126 having still more pulleys 114, and irrespective of the position of the extensible frame 118, the cross shaft 126 lies between the end shaft 110 and drive shaft 112 on the elevated section 20. The end frame 120 carries another end shaft 128 having more pulleys 114, and that shaft lies at the downstream end of the delivery conveyor 10.

The pulleys 114 of the four shafts 110, 112, 126 and 128 have endless belts 130 extended over them, and these belts form a conveying pass that extends between the pulleys 114 of the two end shafts 110 and 128 for carrying signatures S in a shingled condition away from the elevated downstream end of the shingling conveyor 8. After looping over the pulleys 114 on the end shaft 128, the belts 130 form a return pass which extends back to the pulleys 114 of the cross shaft 126, then forwardly to the pulleys 114 of the drive shaft 112 and thence rearwardly again to the pulleys 114 of the other end shaft 110. This arrangement enables the extensible frame 118 to extend and retract without changing the tension in the belts 130.

Figure 9:
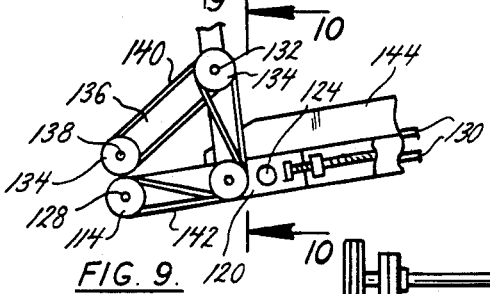
FIG. 9 is a partial elevational view of the downstream end of the delivery conveyor.

The end frame 120 also supports an elevated cross shaft 132 (FIGS. 8 & 10) which extends over the upper passes of the belts 130. The shaft 132, aside from being fitted with more pulleys 134, has arms 136 which extend forwardly from it and downwardly and at their ends are connected by another end shaft 138 that lies directly above the end shaft 128. The end shaft 138 is fitted with still more pulleys 134. Extended over the pulleys 134 of the two shafts 132 and 138 are endless hold down belts 140. The elevated cross shaft 132 is coupled to the end shaft 128 through a belt drive 142 (FIG. 9) which drives the lower passes of the hold down belts 140 in the same direction as the upper passes of the belts 130, and at generally the same velocity as well. For every belt 130, a corresponding hold down belt 140 exists, and indeed the belts 130 and 140 align, producing more nips n (FIGS. 8 & 10) at the downstream end of the delivery conveyor 10.

Figure 10:
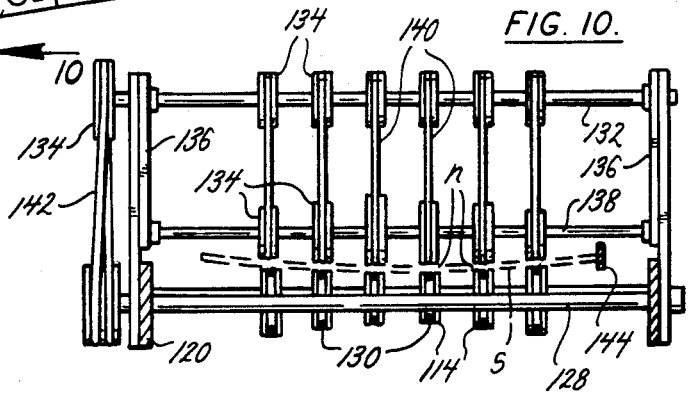
FIG. 10 is a sectional view taken along line 10—10 of FIG. 9.

Whereas the pulleys 114 on the shafts 110, 112, and 126 for the belts 130, and the pulleys 134 on the elevated cross shaft 132 for the hold down belt 140 are of uniform size, the pulleys 114 on the end shaft 128 and the pulleys 134 on the end shaft 138 vary in size (FIG. 10). In particular, the pulleys 114 at the center of the shaft 128 are smaller than the pulleys 114 nearer the ends of the shaft 128, while the pulleys 134 at the center of the shaft 138 are larger than the pulleys 134 nearer the ends of that shaft. This difference in size imparts a bow to the signatures S as they pass through the nip n between the belts 130 and 140, so the signatures S acquire some rigidity and do not fold downwardly upon emerging from the nips n. In other words, the signatures S are projected from the delivery conveyor 10 in a generally bowed downwardly condition and are projected forwardly and downwardly in that condition.

Finally, the delivery conveyor 10 includes a guide 144 (FIGS. 7 & 8) which is attached to its extensible frame 118 and lies along the belts 130 at one of the sides for the array of conveying passes formed by those belts 130. The guide 144 serves to deflect the signatures S as they move along the belts 130, so that the signatures S achieve a reasonable measure of alignment before they enter the nips n between the table and hold down belts 130 and 140. The guide 144, of course, moves with the end frame 120 when it undergoes longitudinal adjustment.

The end frame 120 may be fitted with a sonar type sensor 146 (FIG. 8) which is located beyond the pulleys 114 and 134 on the two end shafts 128 and 138 where it is focused downwardly toward the region into which the delivery conveyor deposits the signatures S to form a stack, this region being normally the hopper of a binding machine. The sensor 146 detects the elevation or height of signatures S in the stack so formed, and is connected to the circuitry of the machine A to control the speed of its motors 32, 42, 52, 62, 82 and 116 such that they deliver the signatures S at a speed which maintains the level of signatures in the hopper reasonably constant. In other words, by reason of the sensor 146 the machine A matches the speed of its delivery to the speed at which a binding machine withdraws signatures S from its hopper.

In operation, a workman loads the machine A with signatures S simply by grasping a group or hand lift of reasonable length and placing it onto the table belts 30 of the feed conveyor 4 beyond the upstream ends of the side belts 40 for that conveyor. He then urges the group forwardly along the table belts 30, whereupon the signatures S pass between the side belts 40 and assume a bowed condition, inasmuch as the side belts 40 are spaced apart at a distance less than the width of the signatures S. Actually, the workman will force the bundle forwardly until the lead signature S comes to the downstream ends of the gaps g at the sides of the feed conveyor or else comes against the last signature S that is already on the feed conveyor 4. The gaps g at the ends of the feed conveyor 4 accommodate the user's hands and facilitate the installation of the signatures S.

The table and side belts 30 and 40 of the feed conveyor 4 force the signatures S through the constriction formed by the gates 64 at the juncture between the feed and spreading conveyors 4 and 6, and indeed the angular position of the gates 64 depends on the force exerted on the signatures S by the feed conveyor 4. These gates 64, through the circuitry of the machine A, regulate the speed of the feed conveyor 4, so that the feed conveyor 4 exerts a desired force on the signatures S at the entrance to the spreading conveyor 6.

The spreading conveyor 6 picks up the signatures S with its table and side belts 50 and 60 and moves them away from the constriction formed by the gates 64 with a slight separation existing between the signatures S by reason of the greater speed of the table and side belts 50 and 60. Thus, the signatures S, while remaining edge standing on the spreading conveyor 6, are nevertheless arranged somewhat loosely in contrast to the packed condition on the feed conveyor 4. The belts 50 and 60 of the spreading conveyor 6 drive the signatures S one after the other into the lift belts 80 of the shingling conveyor 8.

The lift belts 80 move the signatures S one after the other away from the table belts 50 of the spreading conveyor 6 and into the nips n formed between the lift and backing belts 80 and 100 at the lower ends of the articulated frames 86. Actually, the lift belts 80 elevate each signature S only a short distance, which is considerably less than its height, before another signature S contacts them and is likewise elevated, so that the signatures S assume a shingled condition between the lift and backing belts 80 and 100. The offset between the center and outside lift belts 80 (FIG. 6) enables the lift belts 80 at the downstream end of the spreading conveyor 6 to conform to the bow in the signature S and thus facilitates a uniform contact. The sensing elements 106 located along the outside lift belts 80 establish this contact with even more precision, in that they sense when one side or the other of the signatures S lags along the spreading conveyor 6 and increase the speed of the side belt 60 along which the lagging side of the signatures S lie so as to eliminate the lag. This ensures that the two sides of each signature S approach the outside lift belts 80 concurrently, thus avoiding skewing as the lift belts 80 elevate the signatures S. The sensing element 106 along the center belt 80 detects the position of the lower ends of the signatures S on the spreading conveyor 6 and through the circuitry of the machine A controls the speed of the motor 52 for the table belts 50 so that the signatures S remain at a proper angle with respect to the table belts 50, and that angle should be such that it ensures uniform shingling instead of clumping along the shingling conveyor 8.

The articulated frames 86 formed by the pairs of short and long arms 88 and 90 along which the backing belts 100 pass hold the inner runs of the backing belts 100 against the upwardly directed lifting passes of the lift belts 80, yet accommodate for variances in the thickness of the shingled signatures S between the lift and backing belts 80 and 100. As the signatures S rise between the lift and backing belts 80 and 100, the offset in the lifting passes of the lift belts 80 disappears and by the upper ends of those passes is eliminated altogether, so that the signatures S bend easily around the transition formed by the pulleys 78 on the upper shaft 74. Indeed, the diverging section of the inner runs for the backing belts 100 directs the shingled signatures S onto the adjacent horizontal passes of the lift belts 80, and those passes convey the shingled signatures S to the delivery conveyor 10.

The table belts 130 of the delivery conveyor 10 move the signatures S against the guide 144 which deflects them into good alignment. The aligned signatures S then pass into the nips n between the table belts 130 and the hold down belts 140. The pulleys 114 and 134 at the nips n, being of varying size, impart a slight bow to the signatures S as they pass through the nips n (FIG. 10), and this bow rigidifies the signatures S so that they project outwardly from the downstream end of the delivery conveyor 10 without folding downwardly. As a consequence, the signatures S are placed flat one upon another and form a vertical stack on some supporting surface which is usually within the hopper of a binding machine. The adjustment mechanisms 122 and 124 for the extensible and end frames 118 and 120 enable the signatures S to be directed precisely into a hopper without moving the entire machine A.

The sonar detector 146, through the circuitry, exercises a control over the speed of all of the gear motors 32, 42, 52, 62, 82, 116, and enable those motors to deliver signatures S at essentially the speed at which they are withdrawn from the stack that is established, such as within the hopper of a binding machine. Thus, the height of signatures S in a hopper remains essentially constant at an elevation which insures optimum performance of the binding machine. Hence, the binding machine A operates with less stoppages.

This invention is intended to cover all changes and modifications of the example of the invention herein chosen for purposes of the disclosure which do not constitute departures from the spirit and scope of the invention.

What is claimed is:

1. A machine for lifting flexible sheets in a shingled condition, said machine comprising: a first frame; lift belts extending along the first frame; means on the first frame for organizing the lift belts into passes including an upwardly directed lifting pass and an adjacent pass with the belts undergoing a change in direction at the transition between the two passes; means for driving the lift belts such that they move upwardly in their lifting passes and away from the lifting passes in the adjacent passes; a second frame; endless backing belts extending along the second frame; and rollers on the second frame for organizing the backing belts into inner and outer runs and upper and lower transitions between the runs, the inner runs being presented toward and along the lifting passes of the lift belts, at least some of the rollers directing the weight of the second frame against the backing belts such that the backing belts remain taut and are urged at their inner runs toward the lifting passes of the lift belts, so that the sheets are captured between the lifting passes of the lift belts and the inner runs of the backing belts.

2. A machine according to claim 1 wherein the second frame has articulated arms which pivot relative to the first frame and are pivotal connected to each other.

3. A machine according to claim 1 wherein the second frame has upper and lower arms, the upper arms being pivotally connected to the first frame and lower arms being pivotally connected to the upper arms at an angle to the first arms and extending generally along the upwardly directed passes of the lift belts.

4. A machine according to claim 3 wherein the inner passes of the backing belts diverge from the lifting passes of the lift belts at the transition between the lifting and adjacent passes of the lift belts, but after diverging still remain above the adjacent passes of the lift belts.

5. A machine according to claim 4 wherein the upper arms are pivotally connected to the first frame at the upper transitions between the inner and outer runs of the backing belts.

6. A machine according to claim 5 wherein the weight of the articulated frame is applied to the backing belts at the lower transitions between their inner and outer runs.

7. A machine according to claim 6 and further comprising a conveyor located below the lower transitions between the inner and outer runs of the backing belts for delivering sheets in succession in an edge-standing condition, to the lifting passes of the lifting belts, so that the lifting belts elevate the sheets in succession such that they move between the lifting passes of the lift belts and the inner runs of the backing belts in a shingled condition.

8. A machine according to claim 7 wherein lift belts are organized into a center lift belt and side lift belts, with the side belts being at the sides of the center lift belt; and wherein at the region where the upwardly directed passes are presented toward the conveyor, the side lift belts are offset from the center belt so as to conform to edge-standing sheets that are bowed slightly on the conveyor.

9. A machine for converting a group of marginally registered sheets into a shingled stream, said machine comprising: a surface for supporting the sheets in an edge-standing condition; said belts located along the sides of the surface and being spaced apart a distance slightly less than the width of the sheets, so the sheets assume a bowed condition on the surface; first drive means for driving the side belts so that they advance the edge-standing sheets, with the drive means having the capacity to operate the side belts at different velocities; outside lift belts rising from the region of the supporting surface near the side belts so that the sheets near their sides contact the outside lift belts,and are advanced one after the other against the outside lift belts; second drive means for driving the outside lift belts such that they move upwardly from the supporting surface so as to lift the sheets from the supporting surface; and sensing means located along the outside lift belts for controlling the positions of the sheets in the regions thereof where the sheets approach and come against the outside lift belts and for condoling the second drive means for the side belts so that the side belts move the sheets evenly against the outside lift belts, whereby the sheets do not skew as they are elevated by the outside lift belts.

10. A machine for conveying a group of marginally registered sheets into a shingled stream, said machine comprising: a surface for supporting the sheets in an edge-standing condition; side belts located along the sides of the surface and being spaced apart a distance slightly less than the width of the sheets, so the sheets assume a bowed condition on the surface; first drive means for driving the side belts so that they advance the edge-standing sheets, with the drive means having the capacity to operate the side belts at different velocities; lift belts rising from the region of the supporting surface, so that the sheets are advanced one after the other against the lift belts; second drive means for driving the lift belts such that they move upwardly from the supporting surface so as to lift the sheets from the supporting surface; and first sensing elements located along the lift belts and bearing against the sheets near the ends of the side belts to detect the positions of the sides of the sheets as they approach the lift belts and to control the second drive means for the side belts so that the side belts move the sheets evenly against the lift belts.

11. A machine according to claim 10 including backing belts located along the lift belts at an elevation above the supporting surface that is greater than the height of the sheets, so that the sheets pass beneath the backing belts before coming against the lift belts, whereby the sheets, shortly after being elevated from the supporting surface by the lift belts, pass beneath the backing belts which hold the sheets against the lift belts.

12. A machine according to claim 10 wherein the supporting surface includes table belts; and further comprising third drive means for advancing the table belts at essentially the same velocity as the side belts; and second sensing elements located along the lift belts in the region of the table belts to detect the position of the lower portions of the sheets as the sheets approach the lift belts and to control the drive means for the table belts so that the table belts move the sheets at the correct angle with respect to the lift belts.

13. A machine according to claim 11 wherein the sheets bow forwardly on the supporting surface in the direction of advance, and the lift belts are offset in relation to each other in the region of the supporting surface, so that the lift belts accommodate the bow in the sheets.

14. A machine according to claim 13 wherein the offset in the lift belts disappears as the lift belts pass along the backing belts.

15. A machine according to claim 14 wherein the lift belts in the region of the backing belts turn forwardly away from the backing belts, with the transition being in the region where an offset in the lift belts is absent; and wherein the backing belts are directed over, but diverge from, the lift belts at the transition where the lift belts turn forwardly, whereby the shingled sheets move over the transition.

16. A machine for converting a group of marginally registered sheets into a shingled stream of sheets, said machine comprising: a feed conveyor having support and side surfaces which support and confine sheets in an edge-standing condition, at least one of the surfaces moving along a conveying path to advance the signatures along the path; a spreading conveyor extending from the downstream end of the feed conveyor and forming a continuation of the conveying path, the spreading conveyor including a supporting surface and side belts having inwardly presented passes which move away form the feed conveyor, the inner passes of the side belts being spaced apart a distance less than the width of the sheets so that the sheets assume a bowed condition while within the spreading conveyor, the side belts of the spreading conveyor moving at a velocity greater than the feed conveyor advances the signatures, so that the sheets separate slightly within the spreading conveyor; constricting elements located at the downstream end of the feed conveyor and at the upstream ends of side belts for the spreading conveyor generally between the side surfaces of the feed conveyor and the side belts of the spreading conveyor and forming a restriction to the movement of sheets from the feed conveyor to the spreading conveyor; and a shingling conveyor at the downstream end of the spreading conveyor and having belts which carry the sheets away from the spreading conveyor in a shingled condition.

17. A machine according to claim 16 wherein the side surfaces of the feed conveyor move to advance the sheets along the conveying path.

18. A machine according to claim 17 wherein the spacing between the side surfaces of the feed conveyor is less than the width of the sheets so that the sheets assume a bowed condition on the feed conveyor.

19. A machine for converting a group of marginally registered sheets into a shingled stream of sheets, said machine comprising: a feed conveyor having conveying surfaces which move sheets in an edge-standing condition along a conveying path; a spreading conveyor extending from the downstream end of the feed conveyor and forming a continuation of the conveying path, the spreading conveyor including a supporting surface and side belts having inwardly presented passes which move away from the feed conveyor, the inner passes of the side belts being spaced apart a distance less than the width of the sheets so that the sheets assume a bowed condition while within the spreading conveyor, the side belts of the spreading conveyor moving at a velocity greater than the velocity at which the feed conveyor advances the signatures, so that the sheets separate slightly within the spreading conveyor; constricting elements located at the downstream end of the feed conveyor and at the upstream ends of side belts for the spreading conveyor and forming a restriction to the movement of sheets from the feed conveyor to the spreading conveyor, the constricting elements being movable inwardly and outwardly with respect to the conveying path such that the position of the constricting elements indicates the force with which the feed conveyor delivers the sheets to the spreading conveyor; and a shingling conveyor at the downstream end of the spreading conveyor and having belts which carry the sheets away from the spreading conveyor in a shingled condition.

20. A machine according to claim 21 wherein the constricting elements are gates which pivot about upright axes and swing inwardly and outwardly with respect to the path.

21. A machine according to claim 20 wherein the gates when swung outwardly lie along the inner passes of the side belts for the spreading conveyor.

22. A machine for delivering sheets generally horizontally, said machine comprising a plurality of endless table belts located side by side to form a conveying path and having upwardly presented conveying passes which move from an upstream end where sheets are deposited on the belts to a downstream end where sheets are discharged from the belts; first pulleys around which the table belts pass at the upstream end of conveying passes; second pulleys around which the table belts pass at the downstream end of the conveying passes, the second pulleys being mounted for rotation about a common axis, the second pulleys near the center of the conveying path having a diameter different from the second pulleys at the outside of the conveying path; hold down belts located above the table belts and having downwardly presented passes which converge toward the upwardly presented passes of the table belts at the downstream end of those upwardly presented passes to form nips between the hold down and table belts; third pulleys around which the hold down belts pass upstream from the second pulleys and maintaining the hold down belts above the conveying passes of the table belts; fourth pulleys around which the hold down belts pass at the second pulleys, the fourth pulleys rotating about a common axis and being free to move upwardly and downwardly so that the nip will accommodate variances in the thickness of sheets passing through it, the fourth pulleys at the center of the path having a diameter different from the fourth pulleys at the outside of the path, with the relationship between the large and small fourth pulleys being the inverse of the relationship between the large and small second pulleys, whereby the sheets upon passing through the nips formed by the table and hold down belts at the second and fourth pulleys, will be bowed and thus have enough rigidity to be projected beyond the downstream ends of the conveying passes for the table belts without folding downwardly.

23. A machine according to claim 22 wherein the third pulleys rotate about a common axis that is fixed in position with respect to the common axis of the second pulleys, and further comprising arms which pivot about the axis for the third pulleys and have free ends which carry the fourth pulleys.

24. A machine according to claim 23 and further comprising means for connecting the second and third pulleys so that the table and hold down belts are driven in unison.

25. A machine according to claim 22 wherein the second pulleys at the center of the path are larger than the second pulleys at the outside of the path, whereas the fourth pulleys at the center of the path are smaller than the fourth pulleys at the outside of the path.

26. A machine for conveying flexible sheets in an edge-standing condition, said machine comprising: an upwardly presented supporting surface capable of supporting a group of sheets, with the sheets standing on edge; a plurality of side belts located along each of the sides of the supporting surface and provided with inwardly presented passes that move from an upstream end to a downstream end and contact the side edges of the edge-standing sheets to advance the sheets to the downstream end, some of the side belts within the set on at least one side of the supporting surface being longer than other side belts in that set such that a void exists between long side belts of the set at the upstream end of the set, with the void opening upstream out of the space between the longer belts and being large enough to accommodate a hand, whereby one can manually move a bundle of sheets along the supporting surface and the longer side belts while still maintaining manual contact with sheets; and means for driving the side belts.

27. A machine according to claim 26 wherein long and short belts as well as voids exist on both sides of the upstream supporting surface.

28. A machine according to claim 27 wherein each set of side belts has upper and lower belts which are longer than the intervening belts to provide the voids.

29. A machine according to claim 28 wherein the supporting surface lies along the upwardly presented passes of endless table belts that move at substantially the same velocity as the side belts.

30. A machine for advancing a succession of marginally registered sheets along a path, said machine comprising: table belts located along the path for supporting the succession of sheets in an edge-standing condition with their bottom edges against the table belts; side belts located along the sides of the path such that the side belts and table belts form a channel in which the edge-standing sheets are contained, the spacing between the side belts being less than the width of the sheets, so that the side belts contact the side edges of the sheets and cause the sheets to bow along the path; first drive means for moving the table belts along the path; second drive means for moving the side belts along the path in the same direction as the table belts; and sensing means for sensing the positions of the sheets at a location along the path and for controlling the first drive means such that the velocity of the table belts relative to the side belts causes the sheets to assume a desired upstanding orientation in the channel at the location where the sensing means senses the positions of the sheets.

31. A machine according to claim 30 and further comprising lift belts located at the downstream end of the channel formed by the table and side belts, the lift belts moving upwardly out of the channel, whereby the lift belts elevate the sheets and remove them from the channel; and wherein the sensing means is located along the lift belts and causes the first drive means to operate the table belts at a velocity which brings the sheets to the lift belts at an orientation which effects a shingling of the sheets along the lift belts.

* * * * *

UNITED STATES PATENT AND TRADEMARK OFFICE

CERTIFICATE OF CORRECTION

PATENT NO. : 5,161,792

DATED : Nov. 10, 1992

INVENTOR(S) : James R. Wood

It is certified that error appears in the above-identified patent and that said Letters Patent is hereby corrected as shown below:

Col. 15, line 7 "pivotal" should be "pivotally"

Col. 15, line 48 "said" should be "side"

Col. 15, line 62 "controlling" should be "detecting"

Col. 15, line 65 "condoling" should be "controlling"

Col. 16, line 68 "form" should be "from"

Col. 17, line 62 after "comprising" insert ":"

Signed and Sealed this

Twenty-sixth Day of October, 1993

*Attest:*

Bruce Lehman

BRUCE LEHMAN

*Attesting Officer*

*Commissioner of Patents and Trademarks*